United States Patent [19]

Gregory

[11] Patent Number: 4,824,437

[45] Date of Patent: Apr. 25, 1989

[54] THERMAL TRANSFER PRINTING SHEET AND PROCESS

[75] Inventor: Peter Gregory, Bolton, England

[73] Assignee: Imperial Chemical Industries PLC, London, England

[21] Appl. No.: 136,444

[22] Filed: Dec. 17, 1987

Related U.S. Application Data

[63] Continuation of Ser. No. 880,732, Jul. 1, 1986, abandoned.

[30] Foreign Application Priority Data

Jul. 23, 1985 [GB] United Kingdom ..... 8518572

[51] Int. Cl.[4] ..... B41M 5/26

[52] U.S. Cl. ..... 8/471; 8/675; 8/679; 428/537.5; 428/913; 428/914; 503/227

[58] Field of Search ..... 8/471; 428/537.5, 913, 428/914; 503/227

[56] References Cited

U.S. PATENT DOCUMENTS

| | | | |
|---|---|---|---|
| 4,094,634 | 6/1978 | Becker et al. | 8/558 |
| 4,212,643 | 7/1980 | Kolliker | 8/470 |

FOREIGN PATENT DOCUMENTS

| | | |
|---|---|---|
| 59-093389 | 5/1984 | Japan . |
| 60-151097 | 8/1985 | Japan . |
| 60-172591 | 9/1985 | Japan . |
| 62-100558 | 5/1987 | Japan . |
| 62-132684 | 6/1987 | Japan . |

OTHER PUBLICATIONS

Derwent Abstract of Japanese Patent JP 62-100558A, p. 14.

Derwent Abstract of Japanese Patent JP 62-132684A, p. 74, Week, 8729.

*Primary Examiner*—A. Lionel Clingman

*Attorney, Agent, or Firm*—Cushman, Darby & Darby

[57] ABSTRACT

A thermal transfer printing sheet comprising a substrate having a coating comprising an anthraquinone dye of the formula:

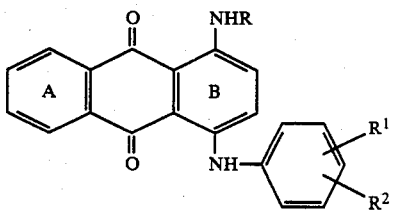

wherein

R is $C_{1-6}$-alkyl, $C_{4-8}$ -cycloalkyl or $C_{2-6}$-alkenyl;

$R^1$ is $C_{1-6}$-alkyl or $C_{2-6}$-alkenyl;

and $R^2$ is H or $C_{1-6}$-alkyl or $C_{2-6}$-alkenyl, and its use in the preparation of a printed image on a receiver sheet by selective heating of the transfer sheet, in accordance with a pattern information signal, while in contact with the receiver sheet.

9 Claims, No Drawings

THERMAL TRANSFER PRINTING SHEET AND PROCESS

This is a continuation of application Ser. No. 880,732, filed July 1, 1986, which was abandoned upon the filing hereof.

This specification describes an invention relating to thermal transfer printing (TTP), especially to a TTP sheet carrying a dye or dye mixture In thermal transfer printing a heat-transferable dye is applied to a sheet-like substrate in the form of an ink, usually containing a polymeric or resinous binder to bind the dye to the substrate, to form a transfer sheet. This is then placed in contact with the material to be printed, the receiver sheet, and selectively heated in accordance with a pattern information signal whereby dye from the selectively heated regions of the transfer sheet is transferred to the receiver sheet and forms a pattern thereon in accordance with the pattern of heat applied to the transfer sheet.

Important criteria in the selection of a dye for TTP are its thermal properties, its brightness of shade, its fastness properties, such as light fastness, and its facility for application to the substrate in the preparation of the transfer sheet. For suitable performance the dye should transfer evenly, in proportion to the heat applied to the TTP sheet so that the depth of shade on the receiver sheet is proportional to the heat applied and a true grey scale of coloration can be achieved on the receiver sheet. Brightness of shade is important in order to achieve as wide a range of shades with the three primary dye shades of yellow, magenta and cyan. For this reason anthraquinone dyes are preferred candidates for use in TTP processes.

As the dye should be sufficiently mobile to migrate from the transfer sheet to the receiver sheet at the temperatures employed, from 200°-400° C., it is generally free from water-solubilising and ionic groups, and is thus not readily soluble in aqueous or water-miscible media, such as water and alkanols. Many suitable dyes are also not readily soluble in the hydrocarbon solvents which are commonly used in, and thus acceptable to, the printing industry. Although the dye can be applied to a dispersion in a suitable solvent, it has been found that brighter, glossier and smoother final prints can be achieved on the receiver sheet if the dye is applied to the substrate from a solution. In order to achieve the potential for a deep shade on the receiver it is desirable that the dye should be readily soluble in the ink medium, particularly if it has a relatively low extinction coefficient, as in the case with anthraquinone dyes. It is also important that a dye which has been applied to a transfer sheet from a solution should be resistant to crystallisation so that it remains as an amorphous layer on the transfer sheet for a considerable time.

According to a first aspect of the present invention there is provided a thermal transfer printing sheet comprising a substrate having a coating comprising an anthraquinone dye of the formula:

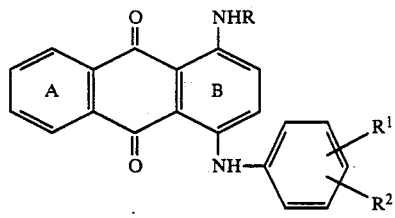

I wherein

R is $C_{1-6}$-alkyl, $C_{4-8}$-cycloalkyl or $C_{2-6}$-alkenyl;

$R^1$ is $C_{1-6}$-alkyl or $C_{2-6}$-alkenyl;

and $R^2$ is H or $C_{1-6}$-alkyl or $C_{2-6}$-alkenyl.

It is preferred that group represented by R is branched alkyl and more especially $C_{3-5}$-alkyl; an especially preferred species being iso-propyl. Examples of other groups represented by R are sec-butyl, iso-butyl, t-butyl, allyl, n-propyl, 2-methylbutyl and cyclohexyl.

It is preferred that $R^2$ is H and that $R^1$ is in a para position with respect to the amino bridging group. It is especially preferred that $R^1$ is methyl. Examples of other groups represented by $R^1$ and $R^2$ are ethyl, n-propyl, iso-propyl, t-butyl, n-butyl and n-hexyl.

Rings A nd B may be substituted in the remaining positions by non-ionic groups, preferably those which are free from acidic hydrogen atoms unless the latter are positioned so that they form intra-molecular hydrogen bonds. Examples of suitable substituents are halogen, especially bromine and chloride, alkyl, especially $C_{1-6}$-alkyl, and hydroxy, especially in positions adjacent to the 9,10-carbonyl groups of the anthraquinone nucleus.

Specific examples of preferred dyes of Formula I for use in the present invention are set out as follows:

| Dye | R | $R^1$ | $R^2$ |
|---|---|---|---|
| 1 | $-CH(CH_3)_2$ | p-$CH_3$ | H |
| 2 | $-CH_3$ | p-$CH_3$ | H |
| 3 | $-CH_3$ | m-$CH_3$ | H |
| 4 | 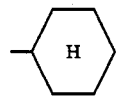 | m-$CH_3$ | H |
| 5 | 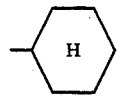 | p-$CH_3$ | H |
| 6 | $-CH_3$ | p-(n-$C_4H_9$) | H |
| 7 | $-CH(CH_3)_2$ | p-(n-$C_4H_9$) | H |
| 8 | $-CH(CH_3)_2$ | p-$CH_3$ | m-$CH_3$ |
| 9 | $-n-C_6H_{13}$ | p-$CH_3$ | H |
| 10 | $-CH(CH_3)CH_2CH_3$ | p-$CH_3$ | H |
| 11 | $-CH_2CH=CH_2$ | p-$CH_3$ | H |
| 12 | $-CH_3$ | $CH_2CH=CH_2$ | H |

The dye of Formula I has good thermal properties giving rise to even prints on the receiver sheet, whose depth of shade is accurately proportional to the quantity of applied heat so that a true grey scale of coloration can be attained.

The dye of Formula I has strong coloristic properties and good solubility in a wide range of solvents, especially those solvents which are widely used and accepted in the printing industry, such as alkanols, e.g.

ethanol & butanol, aromatic hydrocarbons, such as toluene and ketones such as MEK, MIBK and cyclohexanone. This facilitates the application of the dye to the substrate from a solution and thus aids in the achievement of bright, glossy prints on the receiver sheet. The combination of strong coloristic properties and good solubility in the preferred solvents allows the achievement of deep and even shades.

The substrate may be any convenient sheet material capable of withstanding the temperatures involved in TTP, up to 400° C. over a period of up to 20 milliseconds (msec) yet thin enough to transmit heat applied on one side through to the dye on the other side to effect transfer to a receiver sheet within such short periods, typically from 1–10 msec. Examples of suitable materials are paper, especially high quality paper of even thickness, such as capacitor paper, polyester, polyacrylate, polyamide, cellulosic and polyalkylene films, metallised forms thereof, including co-polymer and laminated films, especially laminates incorporating a polyester layer. An especially preferred substrate comprises a laminate of a polyester layer sandwiched between two heat resistant layers of a polymer, such as a UV-cured acrylic resin. The acylic resin serves to protect the polyester from the heat source during printing and to inhibit diffusion of dye into the transfer sheet. The thickness of the substrate may vary within wide limits depending upon its thermal characteristics but is preferably less than 50 μm and more preferably below 10 μm.

The coating preferably comprises a binder and one or more dyes of Formula I. The ratio of binder to dye is preferably from at least 1:1 up to at least 10:1 and more preferably from 1.5:1 to 4:1 in order to provide good adhesion between the dye and the substrate and inhibit migration of the dye during storage.

The binder may be any resinous or polymeric material suitable for binding the dye to the substrate which has acceptable solubility in the ink medium, i.e. the medium in which the dye and binder are applied to the transfer sheet. Examples of binders include cellulose derivatives, such as ethylhydroxyethylcellulose (EHEC), hydroxypropylcellulose (HPC), ethylcellulose, methylcellulose, cellulose acetate and cellulose acetate butyrate; carbohydrate derivatives, such as starch; alginic acid derivatives; alkyd resins; vinyl resins and derivatives, such as polyvinyl alcohol, polyvinyl acetate, polyvinyl butyral and polyvinyl pyrrolidone; polymers and co-polymers derived from acylates and acrylate derivatives, such as polyacrylic acid, polymethyl methacrylate and styrene-acrylate copolymers, polyester resins, polyamide resins, such as melamines; polyurea and polyurethane resins; organosilicones, such as polysiloxanes, epoxy resins and natural resins, such as gum tragacanth and gum arabic.

It is, however, preferred to use a binder which is readily soluble in one of the aforementioned commercially-acceptable organic solvents. Preferred binders of this type are EHEC, particularly the low and extra low viscosity grades, and ethylcellulose.

The coating may also contain other additives, such as curing agents, preservatives, etc., these and other ingredients being described more fully in EP No. 133011A, EP No. 133012A and EP No. 111004A.

According to a further feature of the present invention there is provided a transfer printing process which comprises contacting a transfer sheet coated with a dye of Formula I with a receiver sheet, so that the dye is in contact with the receiver sheet and selectively heating areas of the transfer sheet whereby dye in the heated areas of the transfer sheet may be selectively transferred to the receiver sheet.

The receiver sheet is conveniently a white polyester base, suitable for photographic film, preferably having a superficial coating of a co-polyester into which the dye readily diffuses in order to promote transfer of dye from the transfer sheet to the receiver sheet.

The invention is further illustrated by the following examples in which all parts are by weight unless otherwise indicated.

Ink 1

A solution of 3 g of 1-iso-propylamino-4-(4-methylphenylamino)-AQ in 20 g of cyclohexanone, 30 g of toluene and 17 g of MEK was prepared and stirred for 5 minutes after which 30 g of a 20% solution of EHEC (extra-low viscosity grade) in toluene was added. The ink was stirred for a further 30 minutes with gentle heat to ensure complete dissolution of the solid ingredients.

Ink 2 to Ink 8

A further 7 inks were prepared by dissolving a sample of each of the dyes defined in Table 1 (all of Formula I) in chloroform to make a solution containing 0.45% of dye followed by sufficient EHEC to give a binder level of 0.9% (dye:binder 1:2).

TABLE 1

| Ink | Dye | R | $R^1$ | $R^2$ |
|---|---|---|---|---|
| 1 | 1 | $-CH(CH_3)_2$ | p-$CH_3$ | H |
| 2 | 2 | $-CH_3$ | p-$CH_3$ | H |
| 3 | 3 | $-CH_3$ | m-$CH_3$ | H |
| 4 | 4 | 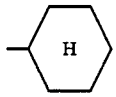 | m-$CH_3$ | H |
| 5 | 5 | 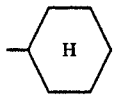 | p-$CH_3$ | H |
| 6 | 6 | $-CH_3$ | p-(n-$C_4H_9$) | H |
| 7 | 7 | $-CH(CH_3)_2$ | p-(n-$C_4H_9$) | H |
| 8 | 8 | $-CH(CH_3)_2$ | p-$CH_3$ | m-$CH_3$ |

Example 1

A transfer sheet, hereinafter called TS1, was prepared by applying Ink 1 to a 6 micron sheet of polyethyelene terephthalate using a wire-wound metal Mayrbar to produce a 2 micron layer of ink on the surface of the sheet. The ink was dried with hot air.

Examples 2 to 8

A further 7 transfer sheets in accordance with the present invention, transfer sheets TS2 to TS8, were prepared according to the procedure of Example 1 using each of Ink 2 to Ink 7, respectively, in place of Ink 1.

Example 9

A sample of TS 1 was sandwiched with a receiver sheet, comprising a composite structure based in a white polyester base having a copolyester receptor surface with the receptor surface of the latter in contact with the printed surface of the former. The sandwich was placed on the drum of a transfer printing machine and passed over a matrix of closely-spaced pixels which were selectively heated in accordance with a pattern information signal to a temperature of <300° C. for a period of 2–10 msec, whereby the dye at the position on the transfer sheet in contact with a pixel while it is hot is is transferred from the transfer sheet to the receiver sheet. After passage over the array of pixels the transfer sheet was separated from the receiver sheet. The printed receiver sheet is hereinafter referred to as RS 1.

Examples 10 to 16

The procedure of Example 9 was repeated using each of transfer sheets TS2 to TS8 in place of TS1 and the printed receiver sheets are hereinafter referred to as RS2 to RS8.

Assessment of Ink, and Transfer & Receiver Sheets

The stability of the inks and the quality of the print on the transfer sheet was assessed by visual inspection and the quality of the printed impression on the receiver sheet was accessed in respect of reflection density of colour by means of a densitometer (Sakura Digital densitometer). The results of the assessments are set out in Table 2:

TABLE 2

| Ink | TS | RS | Stability of Ink | Presence of Crystals on TS | Colour Density of RS |
|---|---|---|---|---|---|
| 1 | 1 | 1 | good | none | 1.31 |
| 2 | 2 | 2 | " | " | 0.83 |
| 3 | 2 | 3 | " | " | |
| 4 | 4 | 4 | " | " | 0.69 |
| 5 | 5 | 5 | " | " | 0.72 |
| 6 | 6 | 6 | " | " | 0.73 |
| 7 | 7 | 7 | " | " | 0.62 |
| 8 | 8 | 8 | " | " | |

I claim:

1. A thermal transfer printing sheet comprising a substrate having a thickness less than 10 micrometers, carrying a coating comprising a resin or polymeric binder and an anthraquinone dye of the formula:

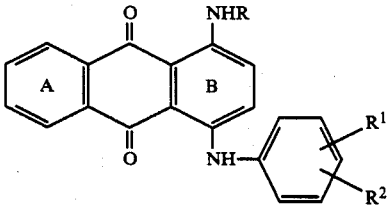

wherein R is $C_{1-6}$-alkyl, $C_{4-8}$-cycloalkyl or $C_{2-6}$-alkenyl;

$R^1$ is $C_{1-6}$-alkyl or $C_{2-6}$-alkenyl; and $R^2$ is H, $C_{1-6}$-alkyl or $C_{2-6}$-alkenyl.

2. A thermal transfer printing sheet according to claim 1 wherein R is branched $C_{3-5}$-alkyl.

3. A thermal transfer printing sheet according to claim 1 wherein $R^1$ is 4-methyl and $R^2$ is H.

4. A thermal transfer printing sheet comprising a substrate having a thickness less than 10 micrometers, carrying a coating comprising a resin or polymeric binder and the dye 1-i-propylamino-4-(4-methylphenylamino)-anthraquinone.

5. A thermal transfer printing sheet according to claim 1 wherein the polymeric binder is ethylhydroxyethyl cellulose or ethyl cellulose.

6. A thermal transfer printing sheet according to claim 1 wherein the resin or polymeric binder is solvent-soluble and the dye is dissolved in the resin or polymeric binder.

7. A thermal transfer printing sheet according to claim 6 wherein the polymeric binder is ethylhydroxyethyl cellulose or ethyl cellulose.

8. A thermal transfer printing sheet comprising a substrate selected from capacitor paper, polyester, polyacrylate, polyamide, cellulosic and polyalkylene films and metallised forms thereof and laminates incorporating a polyester, the substrate having a coating comprising a resin or polymeric binder and an anthraquinone dye of the formula:

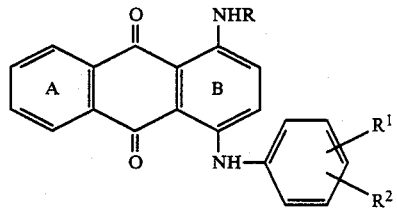

wherein R is $C_{1-6}$-alkyl, $C_{4-8}$-cycloalkyl or $C_{2-6}$-alkenyl;

$R^1$ is $C_{1-6}$-alkyl or $C_{2-6}$-alkenyl; and $R^2$ is H, $C_{1-6}$-alkyl or $C_{2-6}$-alkenyl.

9. A thermal transfer printing process which comprises contacting a thermal transfer printing sheet according to claim 1 with a receiver sheet, so that the surface of the transfer sheet carrying the dye is in contact with the receiver sheet and selectively heating areas of the opposite side of the transfer sheet at a temperature from 300° C. to 400° C. for a period of from 1 to 10 milliseconds in order that dye in the heated areas of the transfer sheet is selectively transferred to the receiver sheet.

* * * * *